US005660013A

United States Patent [19]

Saldarelli et al.

[11] Patent Number: 5,660,013

[45] Date of Patent: Aug. 26, 1997

[54] TAPER-LOCK ANCHOR

[75] Inventors: Thomas A. Saldarelli; Jerry R. Amato; William J. Duffelmeyer, all of Yorktown Hgts, N.Y.

[73] Assignee: KDI Paragon, Inc., LaGrangeville, N.Y.

[21] Appl. No.: 700,574

[22] Filed: Sep. 5, 1996

[51] Int. Cl.[6] ..... E02D 27/00

[52] U.S. Cl. ..... 52/296; 52/301; 52/726.3

[58] Field of Search ..... 52/296, 301, 726.3, 52/726.4, 745.17, 745.18; 404/9

[56] References Cited

U.S. PATENT DOCUMENTS

| | | | |
|---|---|---|---|
| 2,086,009 | 7/1937 | Walker | 52/726.3 X |
| 2,810,598 | 10/1957 | Lief . | |
| 3,349,538 | 10/1967 | Crossman | 52/301 X |
| 4,050,211 | 9/1977 | Wahman | 52/726.3 |
| 4,133,154 | 1/1979 | Ruzicka . | |
| 4,136,811 | 1/1979 | Sato | 52/296 X |
| 4,793,111 | 12/1988 | Shewchuk | 52/296 X |
| 5,063,719 | 11/1991 | Matsuo et al. | 52/296 |

*Primary Examiner*—Lanna Mai

*Attorney, Agent, or Firm*—Sughrue, Mion, Zinn, Macpeak & Seas

[57] ABSTRACT

An anchor system for a hollow tubular support post of a starting platform utilizes a hollow tubular anchor body having a substantially rectangular cross-sectional configuration which is adapted to be imbedded in the deck of a swimming pool. A base plate is connected to the anchor body and has four upstanding projections with tapered outer surfaces defining four corner projections of a truncated pyramid which extends into the hollow tubular anchor body. The anchor body has a plurality of inwardly projecting protrusions adjacent the upper end thereof in each side wall of the anchor body whereby upon insertion of a hollow tubular support post having a substantially rectangular cross-sectional configuration complementary to the cross-sectional configuration of the anchor body, internal surfaces of a lower end of the support post will slide over the four upstanding projections on the base member in frictional contact with the tapered outer surfaces thereof and with the inwardly projecting protuberances disposed in frictional engagement with the outer surfaces of the hollow tubular post.

6 Claims, 3 Drawing Sheets

FIG. 5
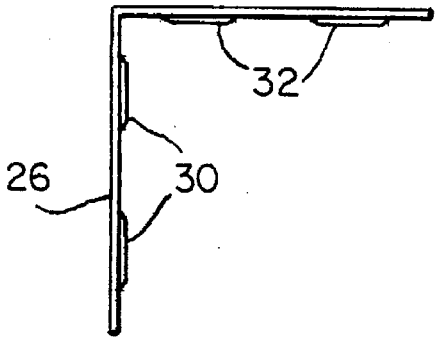
FIG. 4
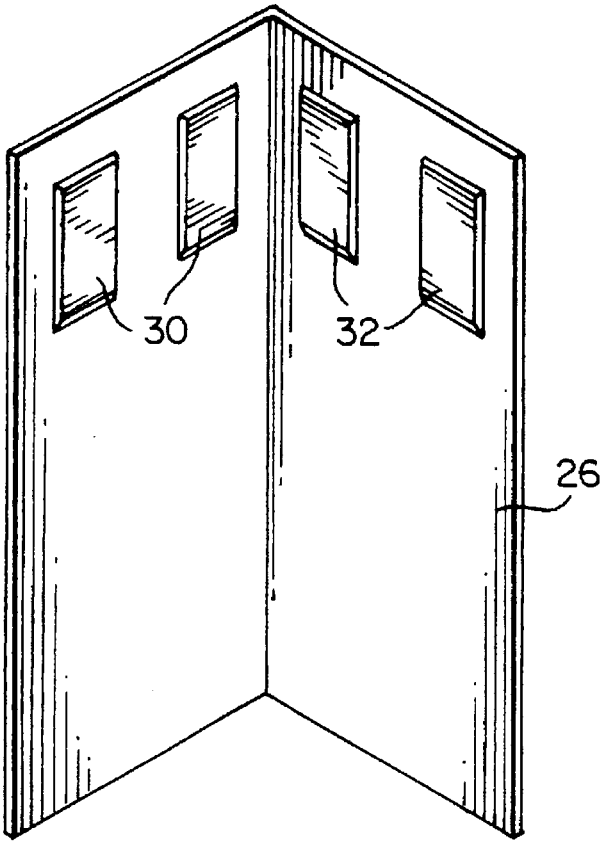
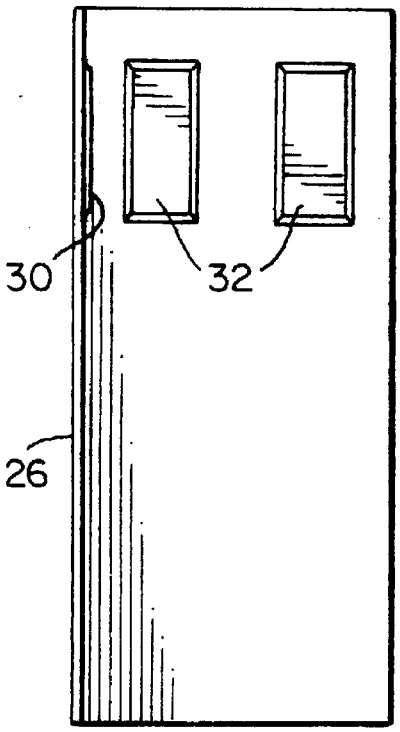
FIG. 6

TAPER-LOCK ANCHOR

BACKGROUND OF THE INVENTION

The present invention is directed to a taper-lock anchor and more specifically for an anchor adapted to be mounted in a swimming pool deck for the reception of the support tube of a starting platform of the type used for swimming races.

Starting platforms for swimming races have been used for many years and various systems have been employed for anchoring the starting platforms to the pool deck. Very few swimming pools are dedicated exclusively to racing and it is necessary for the starting platforms to be removably mounted on the deck in a manner which will ensure the stability of the starting platform. Initially, the support posts for the diving platform were provided with an anchor plate which was bolted to a corresponding fitting which had been set in the concrete material of the pool deck. However, the bolting and unbolting of the platforms proved to be a cumbersome operation and when the platforms were removed, an auxiliary cover was required for the complementary deck member.

In order to facilitate the quick installation and removal of starting platforms, hollow tubular socket members were set in the concrete deck of the pool having a complementary cross-sectional configuration relative to the cross-sectional configuration of the supporting posts for the starting platform. While this provided a much faster changing operation, it proved to be extremely difficult to provide the close tolerances necessary to prevent wobbling of the platform. Various attempts were made at providing wedges which could be driven between the socket and the support post, but such a procedure met with mixed results. Furthermore, if the wedges were driven tight enough to eliminate all wobble, it became extremely difficult to remove the post from the socket when it was desired to remove the starting platforms.

In an attempt to eliminate all wobble, a socket was developed for installation into the deck of a pool wherein the hollow tubular socket had a substantially rectangular cross-sectional configuration. Each side wall of the socket was provided with two pairs of inwardly protruding indentations, one pair adjacent the bottom of the socket and the other pair adjacent the top of the socket. The starting platform was provided with a single tubular support post having a complementary cross-sectional configuration and dimensioned so that each of the pairs of indentations in the socket member would frictionally engage the sides of the post to support the post in a stable manner. However, due to problems involving manufacturing tolerances with respect to the socket and the post, it was still difficult to achieve a completely wobble free installation of the starting platform.

Other types of systems were designed for supporting a post in a socket in a stable manner. The U.S. patent to Ruzicka (U.S. Pat. No. 4,133,154) discloses a system utilizing an elongated tapered socket member having a substantially rectangular configuration which increases in size near the top opening. A collar is secured to the lower end of a post having a complementary configuration to the socket and the post is lowered into the socket until the collar becomes wedged in the tapered socket. In order to prevent wobbling of the post at the upper end of the socket, a plurality of adjustable wedges are provided on all four sides of the post for engagement with the walls of the socket.

The U.S. patent to Lief (U.S. Pat. No. 2,810,598) discloses a system for supporting a post used for store display fixtures. The support base is provided with a tapered socket and the end of the post is provided with a complementary taper so that upon insertion of the post into the socket, the lower end of the post becomes wedged in the socket. Both of the foregoing systems suffered from problems involving manufacturing tolerances which would severely effect the stability of the post within the socket.

SUMMARY OF THE INVENTION

The present invention is directed to a new and improved taper-lock anchor for starting platforms which provides for a quick and easy insertion and removal of the starting platform while providing an extremely stable starting platform free of any undesirable wobble.

The present invention is directed to a new and improved taper-lock anchor system suitable for use with swimming pool starting platforms comprising a hollow tubular anchor body having a substantially rectangular cross-sectional configuration adapted to be imbedded in the deck of a swimming pool, a base plate connected to said anchor body and having four upstanding projections with tapered outer surfaces defining four corner portions of a truncated pyramid, said anchor body having inwardly projecting protrusions adjacent the upper end thereof in each side wall whereby upon insertion of a hollow tubular support post having a substantially rectangular cross-sectional configuration complementary to the cross-sectional configuration of the anchor body, internal surfaces of a lower end of the support post will slide over the four upstanding projections on the base member either in frictional engagement with the tapered outer surfaces thereof or in close proximity thereto depending on manufacturing tolerances and said inwardly projecting protuberances will frictionally engage the outer surfaces of said hollow tubular post.

The above and other objects, features and advantages of the present invention will be more apparent and more readily appreciated from the following detailed description of preferred exemplary embodiment of the present invention, taken in connection with the accompanying drawings.

BRIEF DESCRIPTION OF THE DRAWINGS

FIG. 4 is a perspective view of two adjacent sides of the sleeve.

FIG. 5 is a top plan view of the sides shown in FIG. 4.

FIG. 6 is a side elevation view of the sides shown in FIG. 4.

DETAILED DESCRIPTION OF THE INVENTION

Figure 1:
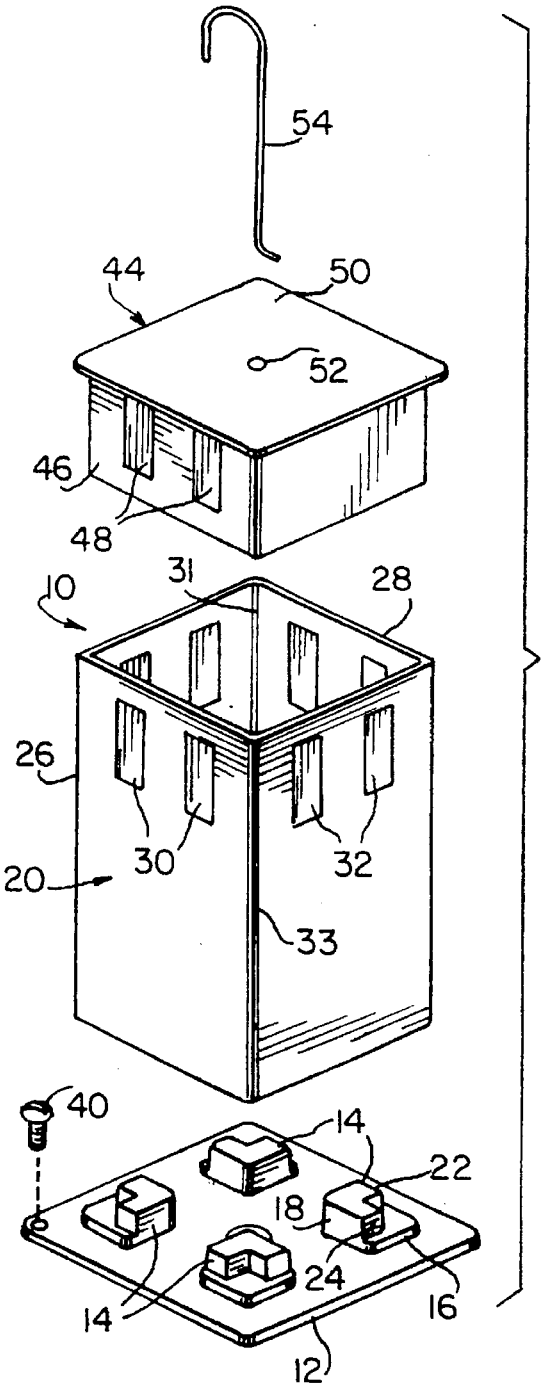
FIG. 1 an exploded perspective view of the taper-lock anchor system according to the present invention.

FIG. 1 is an exploded view of a taper-lock anchor assembly according to a first embodiment of the present invention.

The taper-lock anchor assembly 10 is comprised of a base plate 12 having four identical upstanding projections 14 located adjacent to but spaced from each corner of the substantially square base plate 12. Each projection 14 is comprised of a substantially square shaped bottom portion 16 and an L-shaped upper portion 18. The bottom portion 16 extends outwardly beyond the upper portion 18 along the two outermost sides to provide a flange upon which the anchor body 20 will rest. The outwardly facing side faces 22 and 24 of each projection 14 are tapered inwardly with the tapered surfaces of each projection 14 constituting a portion of a truncated pyramid. The four individual projections 14 are provided in lieu of a solid truncated pyramid primarily for weight reduction purposes with the corners of each upper portion 18 being notched to reduce tolerance problems at the corners when the anchor body 20 is fitted over the projections 14.

The anchor body 20 is comprised of two L-shaped plates 26 and 28 joined together along longitudinal edges by welds 31 and 33. The L-shaped plates 26 and 28 are identical and the L-shaped plate 26 is shown in detail in FIGS. 4, 5 and 6. Two pairs of protrusions 30 and 32 are formed in the upper portion of each wall of the L-shaped plate 26 by stamping the walls of the plate from the opposite sides. The protrusions present relatively broad flat surfaces for sliding engagement with the sides of the hollow tubular platform pedestal which is adapted to be inserted into the anchor body.

Figure 2:
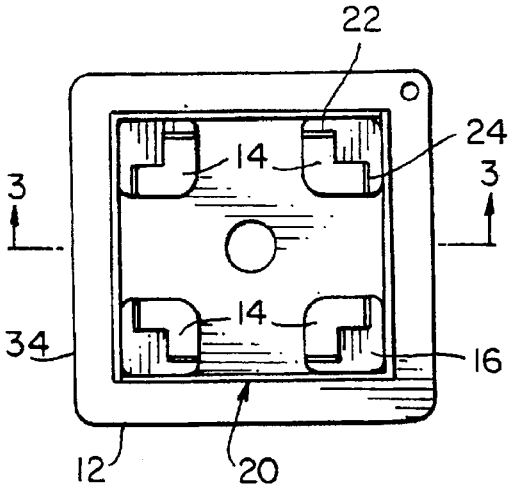
FIG. 2 is a top plan view of the hollow tubular anchor body and base late in assembled condition.
Figure 3:
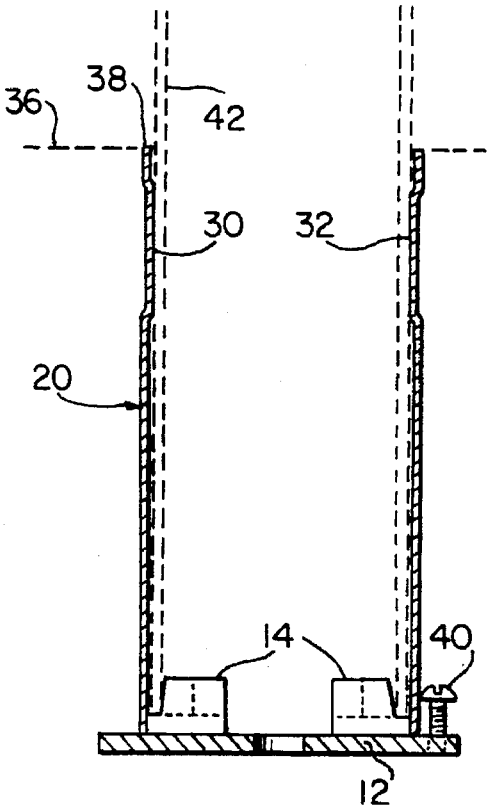
FIG. 3 is a sectional view taken along the line 3—3 in FIG. 2 with the support post shown in phantom lines.
Figure 8:
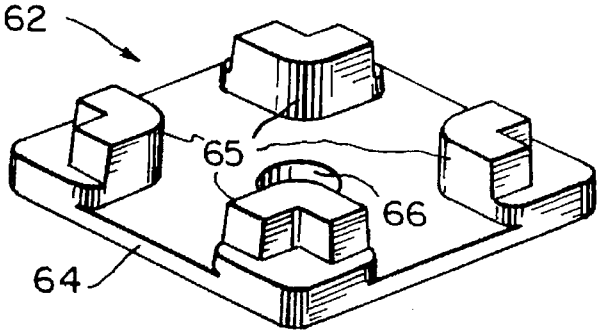
FIG. 8 is a perspective view of the insert anchor plate shown in FIG. 7.
Figure 9:
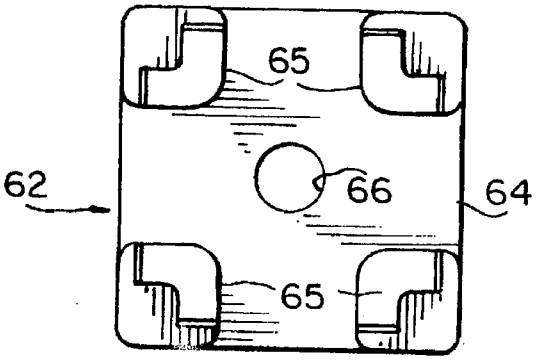
FIG. 9 is a top plan view of the insert anchor plate shown in FIG. 7.

The anchor body 20 is fitted over the four projections 14 on the base member 12 and is dimensioned so as to engage the outwardly facing surfaces of the bottom portion 16 of each projection 14. The anchor body is then welded into permanent engagement with the base plate 12. A portion of the base plate 12 will protrude beyond the anchor body 20 to provide a flange 34 which will assist in securing the assembly when it is set in the concrete of a pool deck 36 which will be flush with the upper edge 38 of the anchor body 20 as shown in FIGS. 2 and 3. A grounding screw 40 is secured in a threaded hole in the flange 34 of the base member 12. When it is desired to mount a starting platform in the taper-lock anchor assembly, the hollow tubular support post 42 of the starting platform, (which is shown in phantom lines in FIG. 3) is inserted into the anchor body 20 with the lower end in frictional engagement with the tapered surfaces 22 and 24 of each projection 14. Depending on the manufacturing tolerances, it is possible that the lower end of the support post 42 will rest on the upper surface of the bottom portion 16 in engagement with the projections 14 or in very close proximity thereto. The protrusions 30 and 32 on the walls of the anchor body 20 will be in tight frictional engagement with the side walls of the support post 42, which has a cross-sectional configuration complementary to that of the anchor body 20.

When the supporting post of the starting platform is removed from the anchor body 20, a cover member 44 is provided to fit tightly into the anchor body 20 to cover the opening in the anchor body, thereby preventing injury and/or the entry of debris into the anchor body. The cover member 44 is provided with a hollow rectangular body 46 having a cross-sectional configuration complementary to the cross-sectional configuration of the anchor body 20. A pair of outwardly extending protrusions 48 are formed on one or more side walls of the body portion 46 for cooperation with the inwardly extending protrusions 30 and/or 32 in the walls of the anchor body 20. The cover is provided with a flat rectangular top 50 which overlies the top edges of the anchor body 20. A hole 52 is provided in the center of the top 50 for the insertion of a bent wire 54 which may be used to facilitate the pulling of the cover member 44 out of the anchor body 20.

While the anchor body assembly as described above with respect to FIGS. 1–6 inclusive is used for new construction where the entire anchor body may be set in the concrete of the pool deck, it is often necessary to retrofit an existing anchor body which would be identical to the assembly shown in FIGS. 1–6 with the exception of the upstanding projections 14 on the base member.

Figure 7:
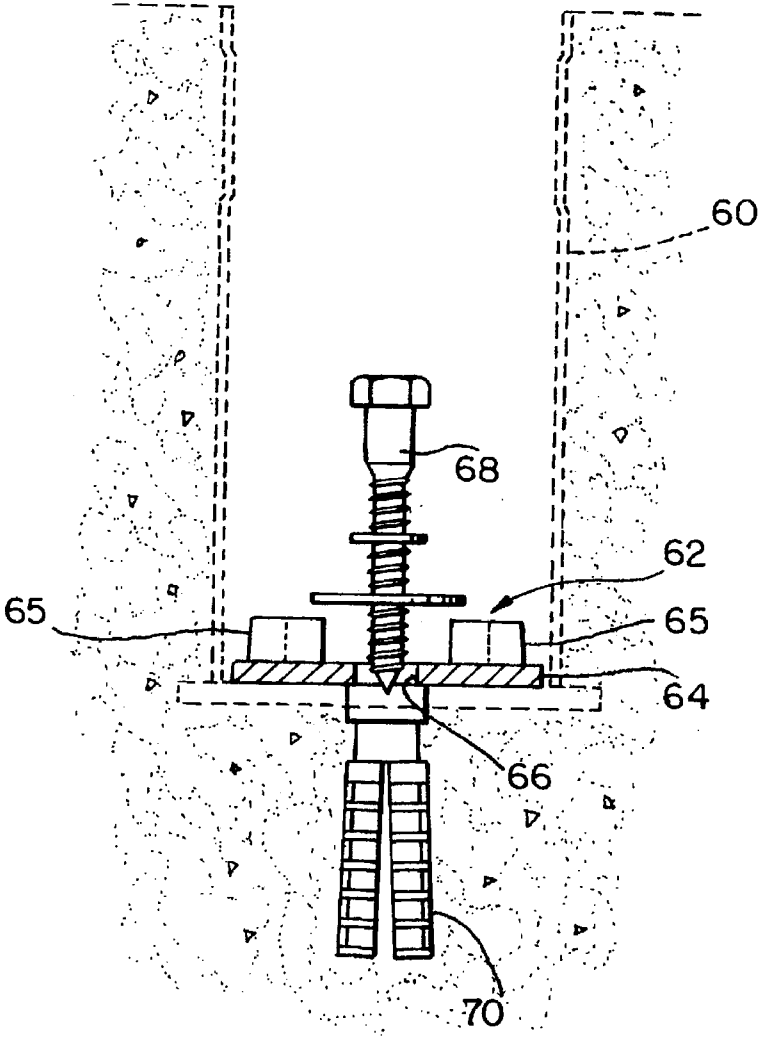
FIG. 7 is a cross-sectional view of a modified taper-lock anchor system using an insert having the four upstanding tapered projections for use in retrofitting a previously installed support socket shown in phantom lines.

FIG. 7 shows a conventional anchor body assembly 60 shown in phantom lines. A taper lock insert 62 is comprised of a base plate 64 having four upstanding projections 65 which are identical to the projections 14 shown in the embodiment of FIGS. 1–6. However, there is no flange on the base plate 64 extending outwardly beyond the projections 65 as in the previous embodiment. Thus the base plate 64 may readily be dropped into an existing anchor body 60 as shown in FIG. 7. The base member 64 is provided with a central opening 66 through which a bolt 68 may extend to be screwed into an anchor member 70 to secure the base member 64 to the base member 72 of the existing anchor body 60.

In both embodiments, all of the components would be of stainless steel in order to prevent corrosion since the anchor assembly would be used in a swimming pool location with the parts coming in contact with water. A body would be formed from stainless steel plates which are stamped and welded to provide a body having the configuration disclosed in the drawings. The base member with the unitary projection would also be of stainless steel using the investment casting process.

While the invention has been particularly shown and described with reference to preferred embodiments thereof, it will be understood by those in the art that the foregoing and other changes in form and details may be made therein without departing from the spirit and scope of the invention.

What is claimed is:

1. An anchor assembly for supporting a post comprising a hollow tubular anchor body having a substantially rectangular cross-sectional configuration, a base plate connected to one end of said hollow tubular anchor body to close said one end, four upstanding projections protruding from an upper surface of said base plate within said hollow tubular anchor body, said projections having tapered outer surfaces defining four corner portions of a truncated pyramid, said hollow tubular anchor body having inwardly projecting protrusions adjacent an upper end of each side wall whereby upon insertion of a hollow tubular post having a substantially rectangular cross-sectional configuration complementary to the cross-sectional configuration of the anchor body, internal surfaces of a lower end of the hollow tubular post will slide over the four upstanding projections on the base member to prevent any substantial lateral movement of said lower end of said hollow post relative to said projection and said inwardly projecting protuberances will frictionally engage outer surfaces of said hollow post.

2. An anchor system as set forth in claim 1, wherein said base plate is provided with a flange extending outwardly beyond each side of said hollow tubular rectangular anchor body for securely embedding the anchor body in concrete.

3. An anchor system as set forth in claim 2, wherein said base plate and said projections are formed as a unitary casting.

4. An anchor system as set forth in claim 1, further comprising a cover member having a downwardly depending body portion with a rectangular cross-sectional configuration complementary to the rectangular cross-sectional configuration of the hollow tubular anchor body for closing an end of said anchor body opposite said base plate.

5. A taper-lock insert for use with a hollow tubular anchor body having a substantially rectangular cross-sectional configuration and a base plate connected to one end thereof for closing said one end, said taper lock insert comprising a base member having four upstanding projections protruding from one surface thereof, said projections each having tapered outer surfaces defining four corner portions of a truncated pyramid and securing means for securing said base member to said base plate of said hollow tubular anchor body with said projections extending into said anchor body whereby upon insertion of a hollow tubular post having a substantially rectangular cross-sectional configuration complementary to the cross-sectional configuration of the anchor body, internal surfaces of a lower end of the support posts will slide over the four upstanding projections on the base member in frictional engagement with the tapered outer surfaces thereof to provide a wobble free support for said post.

6. A taper lock anchor insert as set forth in claim 5, wherein said base member and said projections are comprised of a unitary casting.

* * * * *